US009898972B2

(12) United States Patent
Liu et al.

(10) Patent No.: US 9,898,972 B2
(45) Date of Patent: Feb. 20, 2018

(54) FIELD-SEQUENTIAL DISPLAY PANEL, FIELD-SEQUENTIAL DISPLAY APPARATUS AND DRIVING METHOD

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Peng Liu, Beijing (CN); Ming Yang, Beijing (CN); Pengcheng Lu, Beijing (CN); Qian Wang, Beijing (CN); Xiaochuan Chen, Beijing (CN); Xue Dong, Beijing (CN)

(73) Assignees: BOE TECHNOLOGY GROUP CO., LTD. (CN); BEIJING BOE OPTOELECTRONICS TECHNOLOGY CO., LTD. (CN)

( * ) Notice: Subject to any disclaimer, the term of this patent is extended or adjusted under 35 U.S.C. 154(b) by 0 days.

(21) Appl. No.: 15/309,534

(22) PCT Filed: Sep. 18, 2015

(86) PCT No.: PCT/CN2015/089943
§ 371 (c)(1),
(2) Date: Nov. 8, 2016

(87) PCT Pub. No.: WO2016/192240
PCT Pub. Date: Dec. 8, 2016

(65) Prior Publication Data

US 2017/0186381 A1 Jun. 29, 2017

(30) Foreign Application Priority Data

May 29, 2015 (CN) ..... 2015 1 0289801

(51) Int. Cl.
*G09G 5/02* (2006.01)
*G09G 3/34* (2006.01)
*G09G 3/36* (2006.01)

(52) U.S. Cl.
CPC ..... *G09G 3/3413* (2013.01); *G09G 3/3607* (2013.01); *G09G 2300/0452* (2013.01);
(Continued)

(58) Field of Classification Search
CPC ..... G09G 3/3413; G09G 3/3607; G09G 2300/0452; G09G 2320/0233; G09G 2320/0242
(Continued)

(56) References Cited

U.S. PATENT DOCUMENTS 5,830,527 A * 11/1998 Vickers ..... H01J 9/20 204/192.26
2007/0146242 A1* 6/2007 Miller ..... G09G 3/2074 345/76
(Continued)

FOREIGN PATENT DOCUMENTS

CN 1624538 A 6/2005
CN 101243483 A 8/2008
(Continued)

OTHER PUBLICATIONS

Chinese First Office Action for Chinese Application No. 201510289801.9, dated Nov. 28, 2016, 7 Pages.
(Continued)

*Primary Examiner* — Prabodh M Dharia
(74) *Attorney, Agent, or Firm* — Brooks Kushman P.C.

(57) ABSTRACT

A field-sequential display panel, a field-sequential display apparatus and a driving method are provided. The field-sequential display apparatus includes a liquid crystal display panel and an OLED light source arranged at one side of the
(Continued)

liquid crystal display panel where light is incident to provide trichromatic light for pixel cells of the liquid crystal display panel. The OLED light source includes multiple groups of trichromatic light sources, each of the groups of trichromatic light sources includes a first color sub-light source, a second color sub-light source and a third color sub-light source, and each sub-light source includes an anode, a cathode and a light emitting layer between the anode and the cathode.

2 Claims, 6 Drawing Sheets

(52) U.S. Cl.
CPC ..... *G09G 2320/0233* (2013.01); *G09G 2320/0242* (2013.01)

(58) Field of Classification Search
USPC ..... 345/76, 690–694; 349/69, 129; 362/231; 204/192.26
See application file for complete search history.

(56) References Cited

U.S. PATENT DOCUMENTS

2008/0151144 A1* 6/2008 Hirose ..... G02F 1/133603 349/69
2009/0079769 A1* 3/2009 Iisaka ..... G09G 3/3648 345/693
2010/0245864 A1* 9/2010 Nara ..... G06F 3/1208 358/1.9
2011/0273486 A1* 11/2011 Numao ..... G09G 3/3413 345/690
2014/0140058 A1* 5/2014 Hall ..... F21K 9/00 362/231
2014/0226110 A1* 8/2014 Doyle ..... G02F 1/133603 349/69
2014/0232767 A1* 8/2014 Hammer ..... G09G 3/3611 345/694
2014/0253562 A1 9/2014 Yaras
2014/0267449 A1* 9/2014 Hong ..... G09G 3/3659 345/690
2015/0241621 A1* 8/2015 Inui ..... G02F 1/133615 349/65
2016/0187731 A1* 6/2016 Li ..... G02F 1/133753 349/129
2016/0372060 A1* 12/2016 Arai ..... G09G 3/2003
2017/0110043 A1* 4/2017 Liu ..... G09G 3/2003

FOREIGN PATENT DOCUMENTS

CN 101266371 A 9/2008
CN 201725547 U 1/2011
CN 202977420 U 6/2013
CN 203037965 U 7/2013
CN 103293763 A 9/2013
CN 104820315 A 8/2015
CN 104821161 A 8/2015
JP 2008066366 A 3/2008
JP 4196496 B2 12/2008

OTHER PUBLICATIONS

International Search Report and Written Opinion for Application No. PCT/CN2015/089943, dated Mar. 4, 2016, 14 Pages.
Chinese Second Office Action for Chinese Application No. 201510289801.9, dated Jun. 12, 2017, 6 Pages.

* cited by examiner

FIELD-SEQUENTIAL DISPLAY PANEL, FIELD-SEQUENTIAL DISPLAY APPARATUS AND DRIVING METHOD

CROSS-REFERENCE OF RELATED APPLICATIONS

This application is the U.S. national phase of PCT Application No. PCT/CN2015/089943 filed on Sep. 18, 2015, which claims priority to Chinese Patent Application No. 201510289801.9 filed on May 29, 2015, the disclosures of which are incorporated in their entirety by reference herein.

TECHNICAL FIELD

The disclosure relates to the field of displaying technology, and in particular, to a field-sequential display panel, a field-sequential display apparatus and a driving method.

BACKGROUND

Currently, methods for color display in a liquid crystal display apparatus include a red (R), green (G) and blue (B) filter layer display method and a color field-sequential display method.

For the liquid crystal display apparatus using the RGB filter layer display method, each pixel is divided into three RGB sub-pixels, and a filter layer of the corresponding color is provided for each sub-pixel, and light emitted by a backlight is transmitted to the RGB filter layer through a liquid crystal layer, thereby forming a color image.

For the liquid crystal display apparatus using the field-sequential display method, an RGB color LED lamp is arranged in each pixel cell, rather than the pixel cell is decomposed into three RGB sub-pixels, resulting in that liquid crystal molecules corresponding to the pixel cell are controlled to deflect a predetermined angle in a time-sharing mode, and the RGB color LED lamp is controlled to emit trichromatic light R, G and B in the time-sharing mode through the liquid crystal layer, so that the corresponding color value is displayed in a frame for the pixel cell.

In the field-sequential display method, no color filter layer is needed to be arranged, but only a backlight is used as a color providing source. However, since the RGB color LED lamp in the backlight is needed to keep switching, the life of the LED lamp is greatly reduced, and if the LED lamp is damaged and cannot emit light, the performance of the display apparatus is greatly influenced.

SUMMARY

A field-sequential display panel, a field-sequential display apparatus and a driving method are provided according to embodiments of the disclosure, which can avoid the above-described drawbacks of the LED lamp used as the backlight in the related art.

In order to achieve the above-described objective, the following technical solutions are adopted in the embodiments of the disclosure.

In one aspect, a field-sequential display panel is provided, which includes a lower substrate, an upper substrate and a liquid crystal layer arranged between the lower substrate and the upper substrate, the lower substrate includes pixel cells arranged on a base substrate, and each of the pixel cells includes a thin film transistor; and the field-sequential display panel further includes an OLED light source arranged at one side of the base substrate facing away from the thin film transistor to provide trichromatic light for the pixel cells, the OLED light source includes multiple groups of trichromatic light sources, each of the groups of trichromatic light sources includes a first color sub-light source, a second color sub-light source and a third color sub-light source, and each sub-light source includes an anode, a cathode and a light emitting layer between the anode and the cathode.

Optionally, each pixel cell has a shape of square, and the thickness of the substrate is less than or equal to 10 times a side length of the pixel cell.

Further, optionally, any one of the groups of trichromatic light sources corresponds to the pixel cells in a 4×4 array or a 5×5 array.

In another aspect, a field-sequential display apparatus is provided, which includes a liquid crystal display panel and an OLED light source arranged at one side of the liquid crystal display panel where light is incident to provide trichromatic light for pixel cells of the liquid crystal display panel, where the OLED light source includes multiple groups of trichromatic light sources, each of the groups of trichromatic light sources includes a first color sub-light source, a second color sub-light source and a third color sub-light source, and each sub-light source includes an anode, a cathode and a light emitting layer between the anode and the cathode.

Optionally, each pixel cell in the liquid crystal display panel has a shape of square, and the distance between the liquid crystal display panel and the OLED light source is less than or equal to 10 times a side length of the pixel cells.

Further, optionally, any one of the groups of trichromatic light sources corresponds to the pixel cells in a 4×4 array or a 5×5 array.

Optionally, a light emitting layer of the first color sub-light source is a red light emitting layer, a light emitting layer of the second color sub-light source is a green light emitting layer and a light emitting layer of the third color sub-light source is a blue light emitting layer.

Based on the above, optionally, the OLED light source is an OLED display panel, and the group of trichromatic light sources is a pixel cell of the OLED display panel.

In yet another aspect, a driving method for the field-sequential display panel or the field-sequential display apparatus is provided, and the driving method includes: driving the first color sub-light source in the OLED light source to emit light in a 1st field of each frame, driving the second color sub-light source in the OLED light source to emit light in a 2nd field, and driving the third color sub-light source in the OLED light source to emit light in a 3rd field; and driving liquid crystal molecules in the pixel cells to deflect in each field so that the pixel cells have target trichromatic brightness values in each frame.

Optionally, time durations of the 1st field, the 2nd field and the 3rd field are the same.

In another aspect, a driving method for the field-sequential display panel or the field-sequential display apparatus is further provided, and the driving method includes: driving the first color sub-light source, the second color sub-light source and the third color sub-light source in the OLED light source to emit light in a Rmax:G0:B0 ratio in a 1st field of each frame, driving the first color sub-light source, the second color sub-light source and the third color sub-light source in the OLED light source to emit light in a R0:Gmax:B0 ratio in a 2nd field, and driving the first color sub-light source, the second color sub-light source and the third color sub-light source in the OLED light source to emit light in a R0:G0:Bmax ratio in a 3rd field; driving liquid crystal molecules in the pixel cells to deflect in each field so that the pixel cells have target trichromatic brightness values in each frame, where Rmax and R0, Gmax and G0, and Bmax and B0 represent respectively a maximum brightness value and a minimum brightness value of the light emitted by the first color sub-light source, a maximum brightness value and a minimum brightness value of the light emitted by the second color sub-light source, and a maximum brightness value and a minimum brightness value of the light emitted by the third color sub-light source in per frame of display pictures.

Optionally, the target trichromatic brightness values of the pixel cells in each frame are obtained by the following equation:

$$\begin{pmatrix} R_{max} & R_0 & R_0 \\ G_0 & G_{max} & G_0 \\ B_0 & B_0 & B_{max} \end{pmatrix} \begin{pmatrix} t_1 \\ t_2 \\ t_3 \end{pmatrix} = \begin{pmatrix} R_1 \\ G_1 \\ B_1 \end{pmatrix},$$

where t1, t2 and t3 represent respectively light transmittance of the pixel cells in the 1st field, the 2nd field and the 3rd field, and R1, G1 and B1 represent respectively the target trichromatic brightness values of the pixel cells in each frame.

Optionally, time durations of the 1st field, the 2nd field and the 3rd field are the same.

In another aspect, a driving method for the field-sequential display panel or the field-sequential display apparatus is yet further provided, and the driving method includes: before each frame is processed, determining whether chromaticity coordinates corresponding to colors of the light emitted by all the pixel cells are around a fitted straight line. If it is determined that the chromaticity coordinates corresponding to the colors of the light emitted by all the pixel cells are around the fitted straight line, driving the first color sub-light source, the second color sub-light source and the third color sub-light source in the OLED light source to emit light in a RM:GM:BM ratio in a 1st field of each frame, and driving the first color sub-light source, the second color sub-light source and the third color sub-light source in the OLED light source to emit light in a RN:GN:BN ratio in a 2nd field; driving liquid crystal molecules in the pixel cells to deflect in each field so that the pixel cells have target trichromatic brightness values in each frame, where $$X_1=2.7689R_M+1.7517G_M+1.1302B_M,$$

$$Y_1=1.0000R_M+5.5907G_M+0.0601B_M, Z_1=0R_M+0.0565G_M+5.5943B_M,$$

$$x_1=X_1/(X_1+Y_1+Z_1), y_1=Y_1(X_1+Y_1+Z_1);$$

$$X_2=2.7689R_N+1.7517G_N+1.1302B_N,$$

$$Y_2=1.0000R_N+5.5907G_N+0.0601B_N, Z_2=0R_N+0.0565G_N+5.5943B_N,$$

$$x_2=X_2/(X_2+Y_2+Z_2), y_2=Y_2/(X_2+Y_2+Z_2);$$

where x1 and y1, and x2 and y2 represent respectively maximum coordinates and minimum coordinates of the chromaticity coordinates corresponding to the colors of the light emitted by all pixel cells in each frame.

Optionally, the target trichromatic brightness values of the pixel cells in each frame are obtained by the following equation:

$$\begin{pmatrix} R_M & R_N \\ G_M & G_N \\ B_M & B_N \end{pmatrix} \begin{pmatrix} t_1 \\ t_2 \end{pmatrix} = \begin{pmatrix} R_1 \\ G_1 \\ B_1 \end{pmatrix}$$

where t1 and t2 represent respectively light transmittance of the pixel cells in the 1st field and the 2nd field, and R1, G1 and B1 represent respectively the target trichromatic brightness values of the pixel cells in each frame.

Optionally, time durations of the 1st field and the 2nd field are the same.

With the field-sequential display panel, the field-sequential display apparatus and the driving method according to embodiments of the disclosure, the trichromatic light source is provided for the liquid crystal display panel by using the first color sub-light source, the second color sub-light source and the third color sub-light source of the OLED light source, in order to make the liquid crystal display panel realize color display without a color filter layer. The OLED light source is used as the backlight of the liquid crystal display panel according to embodiments of the disclosure. In one aspect, the switching on and off of each sub-light source may be controlled precisely, with higher flexibility, and brightness values of the trichromatic light may be controlled precisely, providing the field-sequential display panel with better display effect; in another aspect, drawbacks of an LED lamp used as the backlight in the related art may be avoided, providing the field-sequential display panel/apparatus with better performance.

BRIEF DESCRIPTION OF THE DRAWINGS

In order to explain the technical solutions in embodiments of the present disclosure or the related art more clearly, accompanying drawings of the embodiments or the related art are briefly illustrated hereinafter. Apparently, the accompanying drawings described hereinafter are only some embodiments of the present disclosure, and those skilled in the art can further conceive other drawings according to the drawings without creative work.

DETAILED DESCRIPTION

Hereinafter, the technical solutions in embodiments of the disclosure are described clearly and completely in conjunction with the drawings of the embodiments of the disclosure. It is apparent that the described embodiments are only a part of embodiments of the present disclosure. Other embodiments obtained by those skilled in the art on the basis of the embodiments of the present disclosure without creative work fall into the scope of protection of the present disclosure.

Figure 1A:
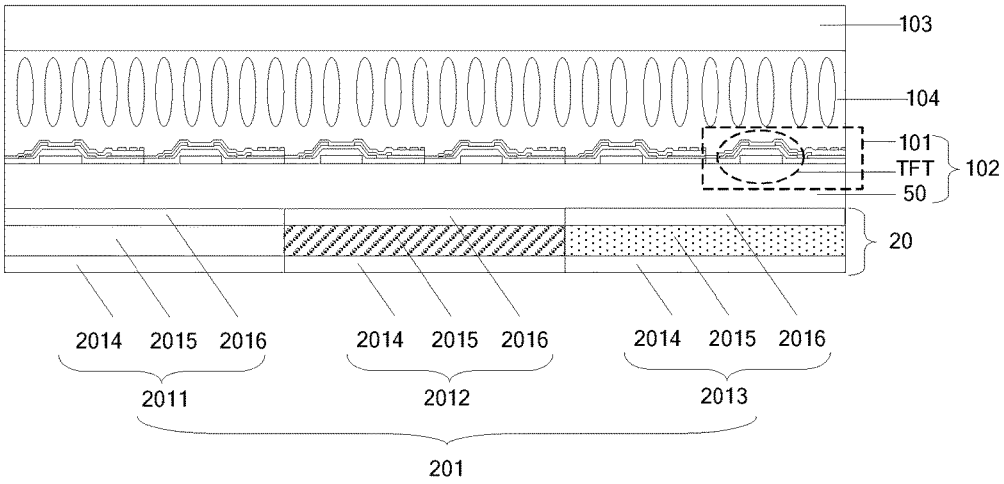
FIG. 1*a* is a schematic diagram of a field-sequential display panel according to one embodiment of the disclosure.

A field-sequential display panel is provided according to one embodiment of the disclosure, as shown in FIG. 1*a*, the field-sequential display panel includes a lower substrate 102, an upper substrate 103 and a liquid crystal layer 104 arranged between the lower substrate 102 and the upper substrate 103. The lower substrate 102 may include pixel cells 101 arranged on a substrate 50, and each of the pixel cells 101 includes a thin film transistor (abbreviated as TFT). Additionally, the field-sequential display panel may further include an OLED light source 20 arranged on one side of the substrate 50 facing away from the thin film transistor to provide trichromatic light for the pixel cells 101.

Figure 1B:
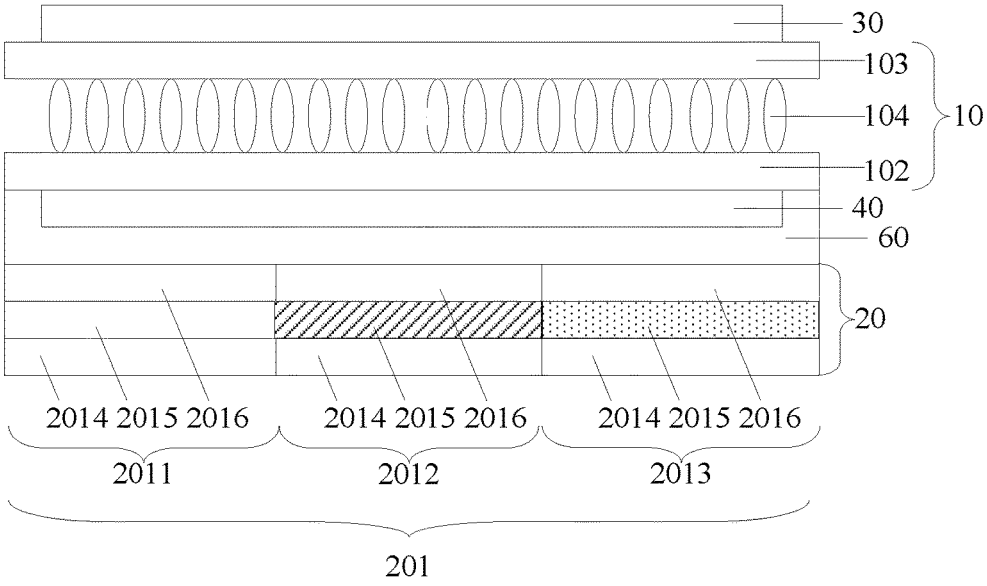
FIG. 1*b* is a schematic diagram of a field-sequential display apparatus according to one embodiment of the disclosure.

The OLED light source may include multiple groups of trichromatic light sources 201, each of the groups of trichromatic light sources 201 includes a first color sub-light source 2011, a second color sub-light source 2012 and a third color sub-light source 2013. As shown in FIG. 1*b*, each sub-light source may include an anode 2014, a cathode 2016 and a light emitting layer 2015 arranged between the anode 2014 and the cathode 2016.

Specifically, for the first color sub-light source 2011, the material of the light emitting layer 2015 is a material emitting a first color light; for the second color sub-light source 2012, the material of the light emitting layer 2015 is a material emitting a second color light; for the third color sub-light source 2013, the material of the light emitting layer 2015 is a material emitting a third color light. The first color, the second color and the third color are different.

Furthermore, for each sub-light source, in addition to the light emitting layer configured for emitting the light of the corresponding color, the sub-light source may further include an electron transporting layer and a hole transporting layer. For further improving the efficiency of injecting electrons and holes into the light emitting layer, the sub-light source may still further include an electron injecting layer arranged between the cathode and the electron transporting layer and a hole injecting layer arranged between the anode and the hole transporting layer.

Each pixel cell 101 of the lower substrate 102 includes the thin film transistor, a pixel electrode and a common electrode, but does not include a color filter layer. The thin film transistor includes a gate, a gate insulating layer, a semiconductor active layer, a source and a drain, and the drain is connected to the pixel electrode. Of course, the lower substrate 102 further includes a gate line connected to the gate and a data line connected to the source.

It should be noted that, firstly, the first color, the second color and the third color may be red, green and blue, respectively, but the embodiment of the disclosure is not limited thereto, and they may also be other three primary colors, for example cyan, magenta and yellow.

Secondly, materials and positions of the anode 2014 and the cathode 2016 in each sub-light source are not limited as long as it can be ensured that the light emitted by each sub-light source towards the lower substrate 102.

Thirdly, each group of trichromatic light sources 201 may correspond to multiple pixel cells 101 in the embodiment of the disclosure.

Based on the above, in order to make the field-sequential display panel display normally, that is, each pixel cell 101 is capable of receiving the light of the first color, the light of the second color and the light of the third color, a certain distance (i.e. the thickness of the substrate 50) exists between the OLED light source 20 and the pixel cells 101. The thickness of the substrate 50 and how many pixel cells 101 the group of trichromatic light sources 201 corresponds to are not limited in the embodiment of the disclosure, so that the light emitted by each sub-light source can be received by each pixel cell 101 of the lower substrate 102, and the light of the corresponding color which meets the brightness requirement can be emitted by the pixel cell 101 in different fields of a frame by controlling the deflection of the liquid crystal.

With the field-sequential display panel according to the embodiment of the disclosure, the trichromatic light is provided for the lower substrate 102 by using the first color sub-light source 2011, the second color sub-light source 2012 and the third color sub-light source 2013 in the OLED light source 20, in order to realize color display without the color filter layer. The OLED light source 20 is used as the backlight of the field-sequential display panel according to the embodiment of the disclosure. In one aspect, the switching on and off of each sub-light source may be controlled precisely, with higher flexibility, and the brightness values of the trichromatic light may be controlled precisely, providing the field-sequential display panel with better display effect; in another aspect, drawbacks of an LED lamp used as the backlight in the related art may be avoided, providing the field-sequential display apparatus with better performance.

Optionally, the shape of the pixel cells 101 is square, and the thickness of the substrate 50 is less than or equal to 10 times a side length of the pixel cells 101. Thus, it may ensure that the light emitted by all the monochromatic sub-light sources of the OLED light source 20, that is, the light emitted by the first color sub-light source 2011, the light emitted by the second color sub-light source 2012 or the light emitted by the third color sub-light source 2013, can be mixed uniformly when reaching the pixel cells 101.

Furthermore, any of the groups of trichromatic light sources 201 in the OLED light source 20 corresponds to the pixel cells 101 in a 4×4 array or a 5×5 array.

Herein, if the group of trichromatic light sources 201 corresponds to less pixel cells 101, which means that a smaller size of each sub-light source in the OLED light source 20 is needed. If the group of trichromatic light sources 201 corresponds to more pixel cells 101, the distance (i.e. the thickness of the substrate 50) between the OLED light source 20 and the pixel cells 101 needs to be increased, in order to make the light reaching the liquid crystal display panel 10 uniform. Therefore, for both the above cases, one group of trichromatic light sources 201 corresponds to the pixel cells 101 in a 4×4 array or a 5×5 array in the embodiment of the disclosure, that is, the size of the OLED light source 20 is controlled within a reasonable range, so as to be suitable for conventional processes and to avoid the field-sequential display panel from being excessively thick.

Figure 2:
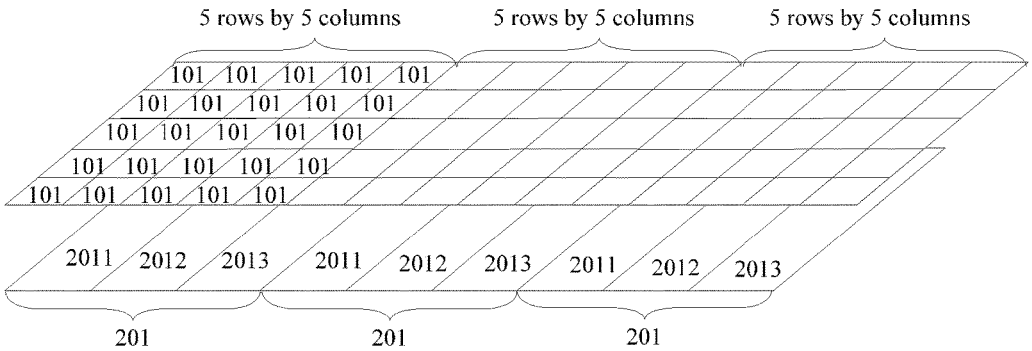
FIG. 2 is a schematic diagram where pixel cells in a liquid crystal display panel correspond to groups of trichromatic light sources in an OLED light source according to one embodiment of the disclosure.

A field-sequential display apparatus is provided according to one embodiment of the disclosure, as shown in FIGS. 1*b* and 2, the field-sequential display apparatus includes a liquid crystal display panel 10 and an organic light-emitting diode (OLED) light source 20 arranged on one side of the liquid crystal display panel 10 where light is incident, and the OLED light source 20 is configured for providing trichromatic light sources for the pixel cells 101 of the liquid crystal display panel 10. Of course, the field-sequential display apparatus may further include an upper polarizer 30 arranged on the other side of the liquid crystal display panel 10 where the light is emergent and a lower polarizer 40 arranged between the liquid crystal display panel 10 and the OLED light source 20.

The OLED light source 20 may include multiple groups of trichromatic light sources 201, each of the groups of trichromatic light sources 201 includes the first color sub-light source 2011, the second color sub-light source 2012 and the third color sub-light source 2013, and each sub-light source includes the anode 2014, the cathode 2016 and the light emitting layer 2015 between the anode 2014 and the cathode 2016.

Specifically, for the first color sub-light source 2011, the material of the light emitting layer 2015 is a material emitting a first color light; for the second color sub-light source 2012, the material of the light emitting layer 2015 is a material emitting a second color light; and for the third color sub-light source 2013, the material of the light emitting layer 2015 is a material emitting a third color light. The first color, the second color and the third color are different.

Furthermore, for each sub-light source, in addition to the light emitting layer for emitting the corresponding color light, the sub-light source may further include an electron transporting layer and a hole transporting layer. For further improving the efficiency of injecting electrons and holes into the light emitting layer, the sub-light source may still further include an electron injecting layer arranged between the cathode and the electron transporting layer and a hole injecting layer arranged between the anode and the hole transporting layer.

Each pixel cell 101 of the liquid crystal display panel 10 includes the thin film transistor, a pixel electrode and a common electrode, but does not include a color filter layer. The thin film transistor includes a gate, a gate insulating layer, a semiconductor active layer, a source and a drain, and the drain is connected to the pixel electrode. Of course, the liquid crystal display panel 10 further includes a gate line connected to the gate and a data line connected to the source.

Specifically, the thin film transistor and the pixel electrode are arranged on the lower substrate 102 of the liquid crystal display panel 10, and the lower substrate 102 is arranged close to the lower polarizer 40. The common electrode may be arranged on the lower substrate 102 or may also be arranged on the upper substrate 103. The upper substrate 103 is arranged close to the upper polarizer 30, and the liquid crystal layer 104 is arranged between the upper substrate 103 and the lower substrate 102.

When the pixel electrode and the common electrode are arranged on the lower substrate 102, for an in-plane switch (abbreviated as IPS) lower substrate, the pixel electrode and the common electrode are arranged spaced apart in the same layer, and both are stripe-shaped electrodes; for an advanced-super dimensional switching (abbreviated as ADS) lower substrate, the pixel electrode and the common electrode are arranged in different layers, the electrode on the upper layer is a stripe-shaped electrode, and the electrode on the lower layer is a plate-shaped electrode. Based on the above, the upper substrate includes a black matrix.

It should be noted that, firstly, the first color, the second color and the third color may be red, green and blue, respectively, but the embodiment of the disclosure is not limited thereto, and they may also be other three primary colors, for example cyan, magenta and yellow.

Secondly, materials and positions of the anode 2014 and the cathode 2016 in each sub-light source are not limited as long as it can be ensured that the light emitted by each sub-light source towards the liquid crystal display panel 10.

Thirdly, each group of trichromatic light sources 201 may correspond to multiple pixel cells 101 of the liquid crystal display panel 10 in the embodiment of the disclosure.

Based on the above, in order to make the field-sequential display panel display normally, that is, each pixel cell 101 is capable of receiving the light of the first color, the light of the second color and the light of the third color, a certain distance exists between the OLED light source 20 and the liquid crystal display panel 10. The distance between the OLED light source 20 and the liquid crystal display panel 10 and how many pixel cells 101 the group of trichromatic light sources 201 corresponds to are not limited in the embodiment of the disclosure, so that the light emitted by each sub-light source can be received by each pixel cell 101 of the liquid crystal display panel 10, and the light of the corresponding color which meets the brightness requirement can be emitted by the pixel cell 101 in different fields of a frame by controlling the deflection of the liquid crystal.

With the field-sequential display apparatus according to the embodiment of the disclosure, the trichromatic light is provided for the liquid crystal display panel 10 by using the first color sub-light source 2011, the second color sub-light source 2012 and the third color sub-light source 2013 in the OLED light source 20, in order to make the liquid crystal display panel 10 realize color display without the color filter layer. The OLED light source 20 is used as the backlight of the liquid crystal display panel 10 according to the embodiment of the disclosure. In one aspect, the switching on and off of each sub-light source may be controlled precisely, with higher flexibility, and brightness values of the trichromatic light may be controlled precisely, providing the liquid crystal display panel 10 with better display effect; in another aspect, drawbacks of an LED lamp used as the backlight in the related art may be avoided, providing the field-sequential display apparatus with better performance.

Optionally, the shape of the pixel cells 101 in the liquid crystal display panel 10 is square, and the distance between the liquid crystal display panel 10 and the OLED light source 20 is less than or equal to 10 times a side length of the pixel cells 101. Thus, it may ensure that the light emitted by all the monochromatic sub-light sources of the OLED light source 20, that is, the light emitted by the first color sub-light source 2011, the light emitted by the second color sub-light source 2012 or the light emitted by the third color sub-light source 2013, can be mixed uniformly when reaching the liquid crystal display panel 10.

Furthermore, any of the groups of trichromatic light sources 201 in the OLED light source 20 corresponds to the pixel cells 101 in a 4×4 array or a 5×5 array of the liquid crystal display panel 10.

Herein, if the group of trichromatic light sources 201 corresponds to less pixel cells 101, which means that a smaller size of each sub-light source in the OLED light source 20 is needed. If the group of trichromatic light sources 201 corresponds to more pixel cells 101, the distance between the liquid crystal display panel 10 and the OLED light source 20 needs to be increased, in order to make the light reaching the liquid crystal display panel 10 uniform. Therefore, for both the above cases, one group of trichromatic light sources 201 corresponds to the pixel cells 101 in a 4×4 array or a 5×5 array in the embodiment of the disclosure, that is, the size of the OLED light source 20 can be controlled within a reasonable range, so as to be suitable for conventional processes and to avoid the field-sequential display apparatus from being excessively thick.

Optionally, the OLED light source 20 is an active matrix type display panel, that is, each sub-light source of the OLED light source 20 includes the thin film transistor.

Furthermore, it is considered that materials emitting the red light, the green light and the blue light in the OLED light source 20 are easy to be prepared, and are applied widely at present. Therefore, the first color, the second color and the third color according to the embodiment of the disclosure may be red (R), green (G) and blue (B), respectively, that is, the light emitting layer 2015 in the first color sub-light source 2011 is a red light emitting layer, the light emitting layer 2015 in the second color sub-light source 2012 is a green light emitting layer and the light emitting layer 2015 in the third color sub-light source 2013 is a blue light emitting layer.

Based on the above, optionally, the OLED light source 20 is an OLED display panel, the group of trichromatic light sources 201 is a pixel cell of the OLED display panel, that is, since the pixel cell of the OLED display panel may include three sub-pixels, the pixel cell of the OLED display panel may be used as the group of trichromatic light sources 201 by controlling the light emitting color of each sub-pixel.

Based on the above, optionally, as shown in FIG. 1*b*, the OLED light source 20 and the lower polarizer 40 are connected via an optical clear resin (OCR) adhesive 60, that is, the OLED light source 20 and the liquid crystal display panel 10 are fixed via the OCR adhesive 60 to form the field-sequential display apparatus. The used OCR adhesive 60 can avoid affecting light transmission.

Unless otherwise specifically defined in the following, it is illustrated in a case that the red light is emitted by the first color sub-light source 2011, the green light is emitted by the second color sub-light source 2012 and the blue light is emitted by the third color sub-light source 2013.

Figure 3:
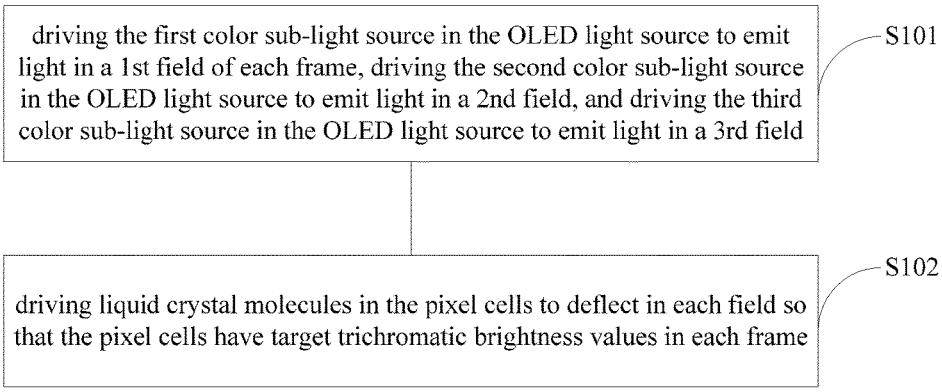
FIG. 3 is a flowchart of a driving method according to one embodiment of the disclosure.

A driving method for the field-sequential display panel/apparatus is provided according to one embodiment of the disclosure, as shown in FIG. 3, the driving method includes the following steps S101 to S102.

Figure 4:
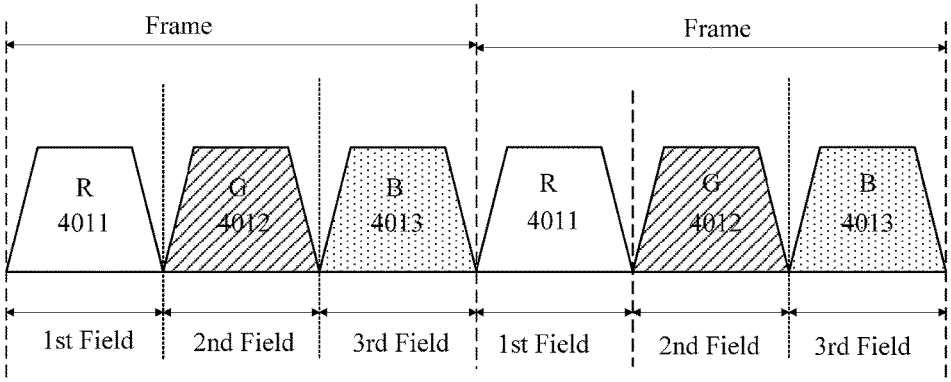
FIG. 4 is a schematic diagram of field-sequential division corresponding to the driving method shown in FIG. 3.

In step S101, as shown in FIG. 4, the first color sub-light source 2011 in the OLED light source 20 is driven to emit light in a 1st field of each frame, the second color sub-light source 2012 is driven to emit light in a 2nd field, and the third color sub-light source is driven to emit light in a 3rd field.

Here, as those skilled in the art should appreciate, for the field-sequential display apparatus, the color value of any pixel cell 101 in the liquid crystal display panel 10 displayed in each frame is obtained based on the trichromatic (red, green and blue) light of the corresponding brightness values respectively displayed in the three fields of each frame, and the trichromatic light is provided by the first color sub-light source 2011, the second color sub-light source 2012 and the third color sub-light source 2013.

In step S102, the liquid crystal molecules in the pixel cells 101 of the liquid crystal display panel 10 are driven to deflect in each field, so that the pixel cells 101 have target trichromatic brightness values in each frame.

Since the target color values of any pixel cell 101 displayed in each frame correspond to a special brightness value of the red light, a special brightness value of the green light and a special brightness value of the blue light (that is, target brightness values of the red light, the green light and the blue light), the light transmittance of the pixel cell 101, that is, the light transmittance of the liquid crystal in the pixel cell 101 in the 1st field, may be obtained based on the brightness value of the red light emitted by the first color sub-light source 2011 in the 1st field and the target brightness value of the red light, and the deflection angle of the liquid crystal in the pixel cell 101 in the 1st field may be obtained based on the light transmittance and specification of the liquid crystal.

Similarly, the light transmittance of the pixel cell 101, that is, the light transmittance of the liquid crystal in the pixel cell 101 in the 2nd field, may be obtained based on the brightness value of the green light emitted by the second color sub-light source 2012 in the 2nd field and the target brightness value of the green light, and the deflection angle of the liquid crystal in the pixel cell 101 in the 2nd field may be obtained based on the light transmittance and specification of the liquid crystal. The light transmittance of the pixel cell 101, that is, the light transmittance of the liquid crystal in the pixel cell 101 in the 3rd field, may be obtained based on the brightness value of the blue light emitted by the third color sub-light source 2013 in the 3rd field and the target brightness value of the blue light, and the deflection angle of the liquid crystal in the pixel cell 101 in the 3rd field may be obtained based on the light transmittance and specification of the liquid crystal.

Based on the above, the liquid crystal molecules in the pixel cells 101 may be driven to deflect an angle in each field by providing the corresponding voltage for the pixel electrode and the common electrode in the liquid crystal display panel 10.

It should be noted that, the brightness value of the light emitted by the first color sub-light source 2011 is the maximum brightness value of the red light which can be emitted in the 1st field, the brightness value of the light emitted by the second color sub-light source 2012 is the maximum brightness value of green light which can be emitted in the 2nd field, and the brightness value of the light emitted by the third color sub-light source 2013 is the maximum brightness value of blue light which can be emitted in the 3rd field.

With the driving method for the field-sequential display panel/apparatus according to the embodiment of the disclosure, the trichromatic light source is provided for the liquid crystal display panel 10 in the 1st field, the 2st field and the 3st field of each frame by using the first color sub-light source 2011, the second color sub-light source 2012 and the third color sub-light source 2013 in the OLED light source 20, in order to make the liquid crystal display panel 10 realize color display without the color filter layer. The OLED light source 20 is used as the backlight of the liquid crystal display panel 10 according to the embodiment of the disclosure. In one aspect, the switching on and off of each sub-light source may be controlled precisely, with higher flexibility, and brightness values of the trichromatic light may be controlled precisely, providing the liquid crystal display panel 10 with better display effect; in another aspect, drawbacks of an LED lamp used as the backlight in the related art may be avoided, providing the field-sequential display panel/apparatus with better performance.

In an example 1, a frame rate is 60 Hz, and the time duration of each frame may be 1/60 s, that is, 16.67 ms. The time duration of each frame is divided into three fields, and the time duration of each field is 5.56 ms. In the 1st field of the frame as shown in FIG. 4, the liquid crystal molecules in each pixel cell 101 are deflected to a first angle and the first color sub-light source 2011 in the OLED light source 20 emits light by progressively scanning the gate line in the liquid crystal display panel 10 by a gate driving circuit and inputting a data voltage to the data line; then the 2nd field is entered, the liquid crystal molecules in each pixel cell 101 are deflected to a second angle and the second color sub-light source 2012 in the OLED light source 20 emits light by progressively scanning the gate line in the liquid crystal display panel 10 by the gate driving circuit and inputting a data voltage to the data line; and then the 3rd field is entered, the liquid crystal molecules in each pixel cell 101 are deflected to a third angle and the third color sub-light source 2013 in the OLED light source 20 emits light by progressively scanning the gate line in the liquid crystal display panel 10 by the gate driving circuit and inputting a data voltage to the data line.

The first angle, the second angle and the third angle described above are related to the light transmittance of the pixel cell 101. The specification of the liquid crystal is different, and the deflection angle of the liquid crystal corresponding to the same light transmittance is also different. When the specification of the liquid crystal is determined, the correspondence between the light transmittance and the deflection angle of the liquid crystal may be looked up based on the specification of the liquid crystal.

It should be noted that, the order of driving the sub-light sources in the OLED light source 20 to emit light and driving the liquid crystal molecules in the pixel cells 101 of the liquid crystal display panel 10 to deflect in each field is not limited according to the embodiment of the disclosure. Additionally, the first angle of deflection of the liquid crystal molecules in each pixel cell 101 is different depending on different target brightness values of each pixel cell 101 in the 1st field. Similarly, the second angle of deflection of the liquid crystal molecules in each pixel cell 101 is different in the 2nd field, and the third angle of deflection of the liquid crystal in each pixel cell 101 is different in the 3rd field.

Optionally, the time durations of the 1st field, the 2nd field and the 3rd field are the same. Therefore, the trichromatic light provided by the OLED light source 20 which may be used as the backlight is distributed more uniformly.

Figure 5:
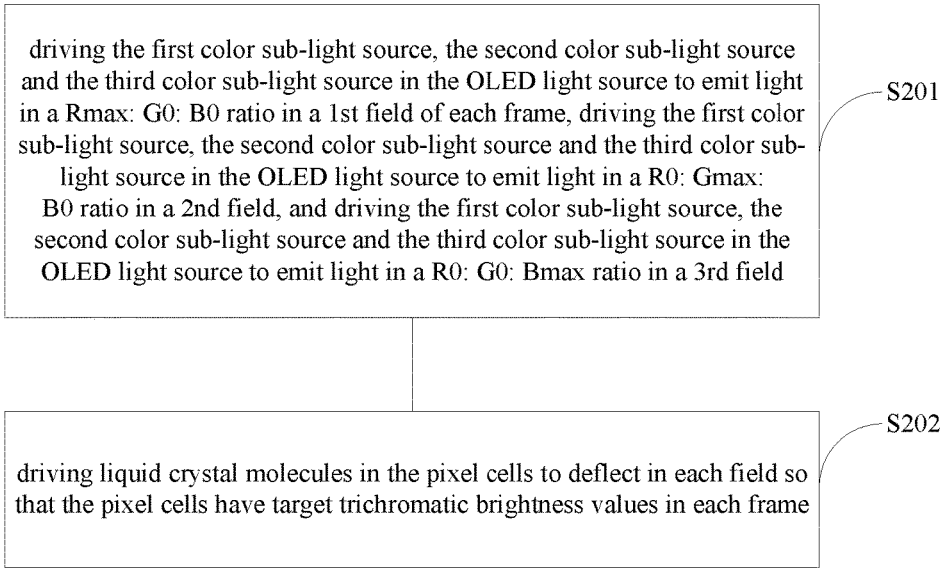
FIG. 5 is a flowchart of another driving method according to one embodiment of the disclosure.

Another driving method for the field-sequential display panel/apparatus is further provided according to one embodiment of the disclosure, as shown in FIG. 5, the driving method includes the following steps S201 and S202.

Figure 6:
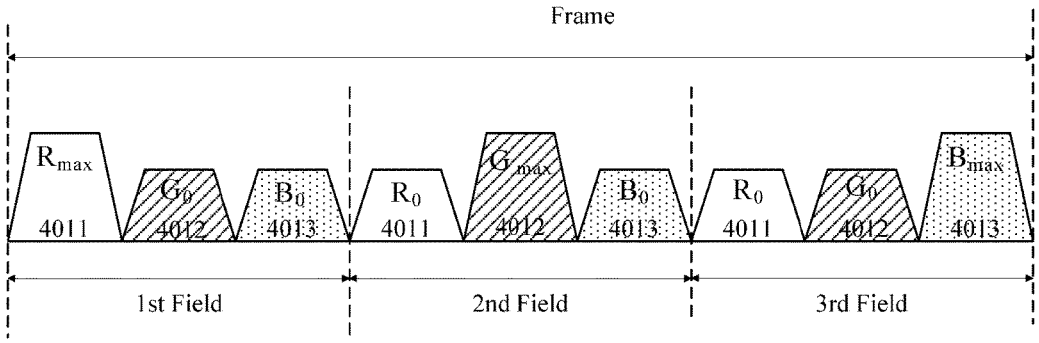
FIG. 6 is a schematic diagram of field-sequential division corresponding to the driving method shown in FIG. 5.

In step S201, as shown in FIG. 6, the first color sub-light source 2011, the second color sub-light source 2012 and the third color sub-light source 2013 in the OLED light source 20 are driven to emit light in a Rmax:G0:B0 ratio in the 1st field of each frame; the first color sub-light source 2011, the second color sub-light source 2012 and the third color sub-light source 2013 in the OLED light source 20 are driven to emit light in a R0:Gmax:B0 ratio in the 2nd field; and the first color sub-light source 2011, the second color sub-light source 2012 and the third color sub-light source 2013 in the OLED light source 20 are driven to emit light in a R0:G0:Bmax ratio in the 3rd field.

Rmax and R0, Gmax and G0, and Bmax and B0 are respectively the maximum brightness value and the minimum brightness value of the light emitted by the first color sub-light source 2011, the maximum brightness value and the minimum brightness value of the light emitted by the second color sub-light source 2012, and the maximum brightness value and the minimum brightness value of the light emitted by the third color sub-light source 2013 in per frame of display pictures. That is, in each filed, light is emitted by the first color sub-light source 2011, the second color sub-light source 2012 and the third color sub-light source 2013 of the OLED light source 20 in a certain ratio of brightness. Based on the above, as those skilled in the art should appreciate, the color value of any pixel cell 101 in the liquid crystal display panel 10 displayed in each frame is obtained based on the trichromatic light of the corresponding brightness value in each frame, and the trichromatic light of the corresponding brightness value in each frame is obtained by superimposing the three fields.

In step S202, the liquid crystal molecules in the pixel cells 101 of the liquid crystal display panel 10 are driven to deflect in each field, so that the pixel cells 101 have target trichromatic brightness values in each frame.

Specifically, since there is a one-to-one correspondence between the color value and the trichromatic brightness value, such as the red light brightness value, the green light brightness value and the blue light brightness value, the corresponding color value may be known by looking up a color value table after the red light brightness value, the green light brightness value and the blue light brightness value of one pixel cell 101 in each frame are known.

The target trichromatic brightness values of any pixel cell 101 of the liquid crystal display panel 10 in each frame are obtained by the following equation:

$$\begin{pmatrix} R_{max} & R_0 & R_0 \\ G_0 & G_{max} & G_0 \\ B_0 & B_0 & B_{max} \end{pmatrix} \begin{pmatrix} t_1 \\ t_2 \\ t_3 \end{pmatrix} = \begin{pmatrix} R_1 \\ G_1 \\ B_1 \end{pmatrix}$$

t1, t2 and t3 represent respectively the light transmittance of the pixel cell 101 in the 1st field, the 2nd field and the 3rd field, and R1, G1 and B1 represent respectively the target trichromatic brightness values of the pixel cell in each frame.

That is, after the target trichromatic brightness values are known, the light transmittance of the pixel cell 101 in the 1st field, the 2nd field and the 3rd field may be calculated based on Rmax and R0, Gmax and G0, and Bmax and B0. On the basis of this, the deflection angle of the liquid crystal molecules in the pixel cell 101 in the 1st field, the 2nd field and the 3rd field may be obtained based on the specification of the liquid crystal.

In the embodiment of the disclosure, the maximum brightness value and the minimum brightness value of the light emitted by the first color sub-light source 2011, the maximum brightness value and the minimum brightness value of the light emitted by the second color sub-light source 2012, and the maximum brightness value and the minimum brightness value of the light emitted by the third color sub-light source 2013 in per frame of display pictures are collected and used as the emitting intensities of the first color sub-light source 2011, the second color sub-light source 2012 and the third color sub-light source 2013 of the OLED light source 20 in each field of the frame. Therefore, the brightness of the light emitted by each sub-light source in the OLED light source 20 may be dynamically adjusted depending on a picture to be displayed by the liquid crystal display panel 10, making power consumption even lower. Additionally, compared with one embodiment where light is emitted by the sub-light source with only one color in the OLED light source 20 in each field of each frame, the overall display brightness may be improved according to the embodiment of the disclosure.

Figure 7:
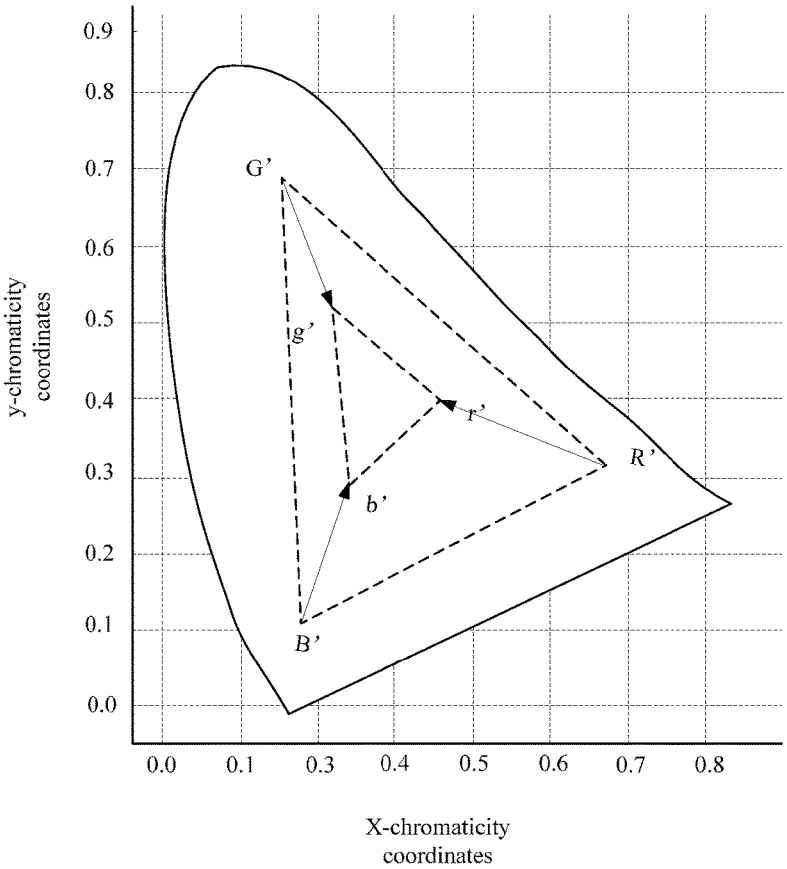
FIG. 7 is a schematic diagram of color gamut coordinates corresponding to the driving method shown in FIG. 5.

With reference to chromaticity coordinates formulated by the Commission Internationale de I'Eclairage (CIE) shown in FIG. 7, a triangular region formed by R', G', and B' is a maximum range of color gamut to be displayed by the liquid crystal display panel 10, but when a picture per frame is displayed, the chromaticity coordinates corresponding to the colors of the light emitted by not all the pixel cell 101 can cover the maximum range of color gamut described above, but only a small proportion of range of color gamut is covered, such as a triangular region formed by r', g', and b' as shown in FIG. 7. Based on the above, it is unnecessary for the OLED light source 20 used as the backlight to provide the trichromatic brightness which is needed by the maximum range of color gamut, but only it is necessary for the OLED light source 20 to provide the trichromatic brightness which is needed by a smaller range of color gamut according to the smaller range of color gamut corresponding to a picture which needs to be displayed in the frame.

Where r' corresponds to (Rmax, G0, B0), g' corresponds to (R0, Gmax, B0), and b' corresponds to (R0, G0, Bmax). The correspondence between coordinates x and y of r' and Rmax, G0 and B0 is described as follows:

$$X_1=2.7689R_{max}+1.7517G_0+1.1302B_0,$$
$$Y_1=1.0000R_{max}+5.5907G_0+0.0601B_0,$$

$$Z_1=0R_{max}+0.0565G_0+5.5943B_0, x_1=X_1/(X_1+Y_1+Z_1), y_1=Y_1/(X_1+Y_1+Z_1).$$

Similarly, the above correspondences between coordinates of g' and R0, Gmax and B0 and between coordinates of b' and R0, G0 and Bmax also exist, which are not repeated any more.

Based on the above, optionally, the time durations of the 1st field, the 2nd field and the 3rd field are the same. Therefore, the trichromatic light provided by the OLED light source 20 which may be used as the backlight is distributed more uniformly.

Figure 8:
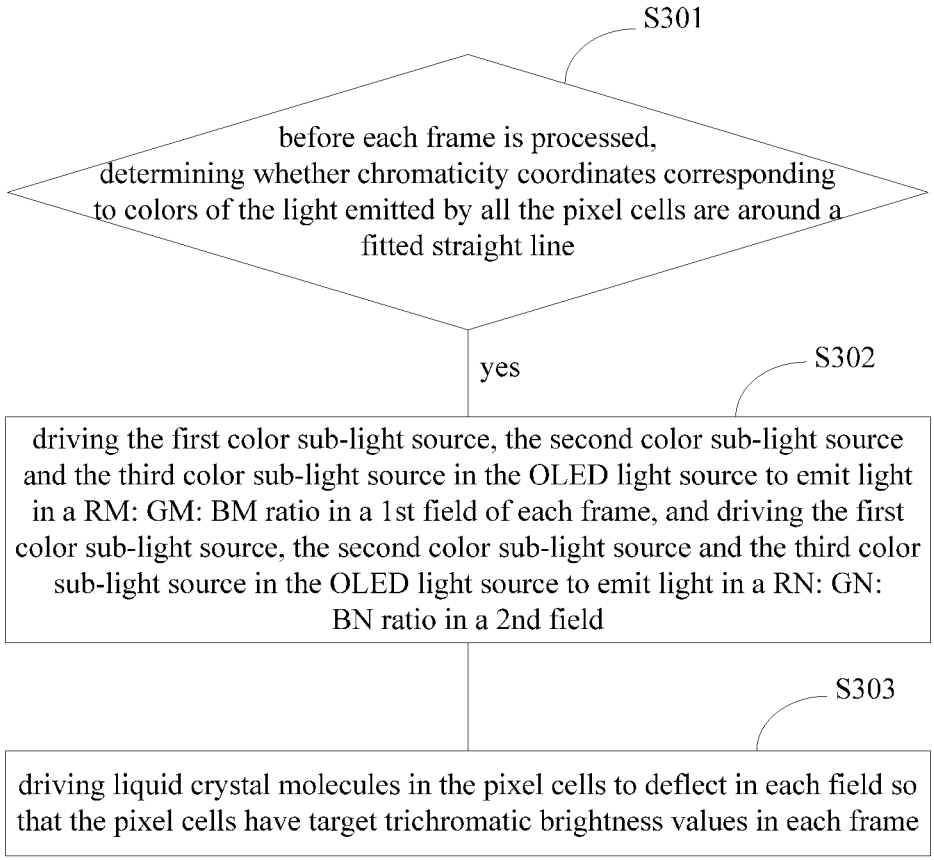
FIG. 8 is a flowchart of yet another driving method according to one embodiment of the disclosure.

Based on the above, a driving method in a special case is provided according to one embodiment of the disclosure, as shown in FIG. 8, the driving method includes the following steps S301 to S303.

In step 301, before each frame is processed, it is determined whether chromaticity coordinates corresponding to colors of the light emitted by all the pixel cells 101 of the liquid crystal display panel 10 are around a fitted straight line. If the chromaticity coordinates corresponding to the colors of the light emitted by all the pixel cells 101 of the liquid crystal display panel 10 are around the fitted straight line, step S302 is performed, otherwise, the above steps S201 to S202 are performed.

Figure 9:
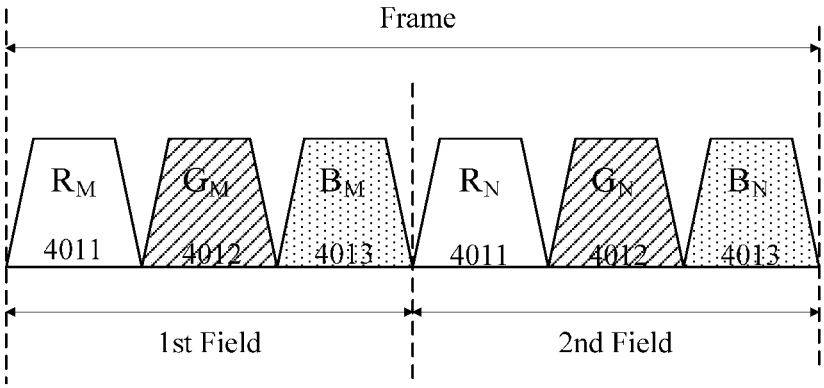
FIG. 9 is a schematic diagram of field-sequential division corresponding to the driving method shown in FIG. 8.

In step S302, as shown in FIG. 9, the first color sub-light source 2011, the second color sub-light source 2012 and the third color sub-light source 2013 in the OLED light source 20 are driven to emit light in a RM:GM:BM ratio in the 1st field of each frame, and the first color sub-light source 2011, the second color sub-light source 2012 and the third color sub-light source 2013 in the OLED light source 20 are driven to emit light in a RN:GN:BN ratio in the 2nd field, where $$X_1=2.7689R_M+1.7517G_M+1.1302B_M,$$

$$Y_1=1.0000R_M+5.5907G_M+0.0601B_M, Z_1=0R_M+0.0565G_M+5.5943B_M,$$

$$x_1=X_1/(X_1+Y_1+Z_1), y_1=Y_1/(X_1+Y_1+Z_1);$$

$$X_2=2.7689R_N+1.7517G_N+1.1302B_N,$$

$$Y_2=1.0000R_N+5.5907G_N+0.0601B_N, Z_2=0R_N+0.0565G_N+5.5943B_N,$$

$$x_2=X_2/(X_2+Y_2+Z_2), y_2=Y_2/(X_2+Y_2+Z_2)$$

Where x1 and y1, and x2 and y2 represent respectively the maximum coordinates and the minimum coordinates of the chromaticity coordinates corresponding to the colors of the light emitted by all the pixel cells of the liquid crystal display panel 10 in each frame.

Figure 10:
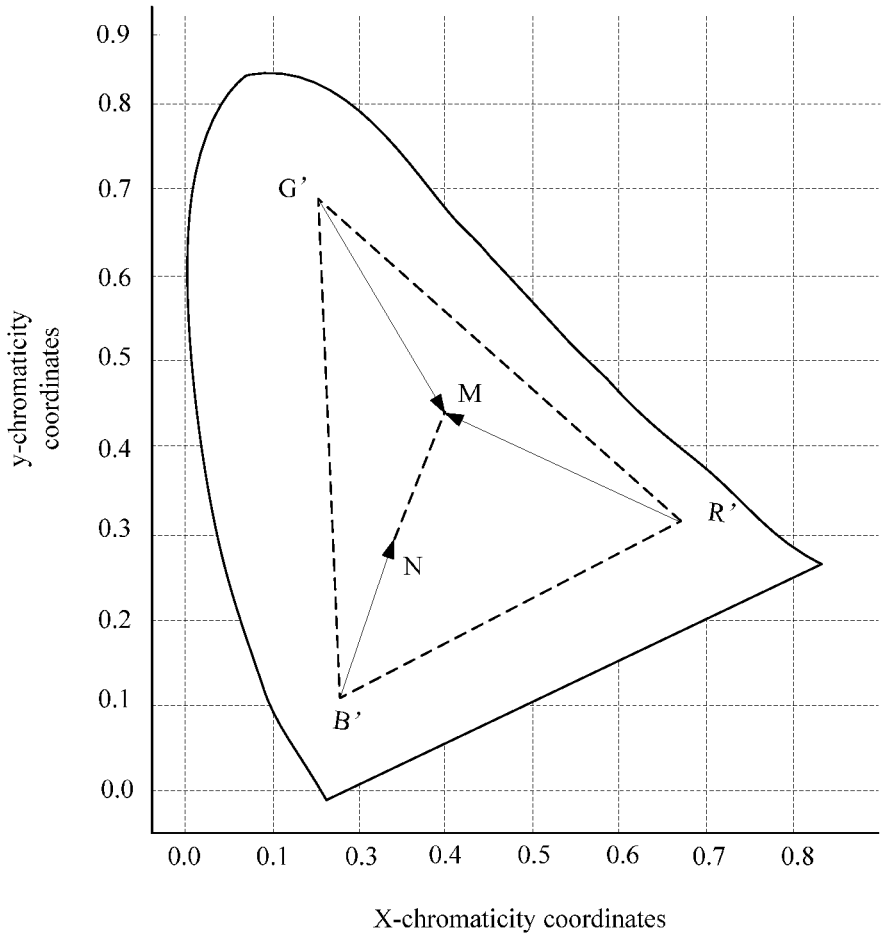
FIG. 10 is a schematic diagram of color gamut coordinates corresponding to the driving method shown in FIG. 8.

That is, referring to FIG. 10, if it is determined that the chromaticity coordinates corresponding to the colors of the light emitted by all the pixel cell 101 of the liquid crystal display panel 10 are around a straight line connecting two points M and N, (RM, GM, BM) corresponding to the M point and (RN, GN, BN) corresponding to the N point may be obtained based on coordinates (x1, y1) of the M point and coordinates (x2, y2) of the N point.

In step 303, the liquid crystal molecules in the pixel cells 101 of the liquid crystal display panel 10 are driven to deflect in each field, so that the pixel cells 101 of the liquid crystal display panel 10 have target trichromatic brightness values in each frame.

The target trichromatic brightness values of any pixel cell 101 of the liquid crystal display panel 10 in each frame may be obtained by the following equation:

$$\begin{pmatrix} R_M & R_N \\ G_M & G_N \\ B_M & B_N \end{pmatrix}\begin{pmatrix} t_1 \\ t_2 \end{pmatrix}=\begin{pmatrix} R_1 \\ G_1 \\ B_1 \end{pmatrix},$$

where t1 and t2 represent respectively the light transmittance of the pixel cells 101 in the 1st field and the 2nd field, and R1, G1 and B1 represent respectively the target trichromatic brightness values of the pixel cell 101 in each frame.

That is, the light transmittance of the pixel cell 101 in the 1st field and the 2nd field may be calculated based on RM and RN, GM and GN, and BM and BN. On the basis of this, the deflection angle of the liquid crystal molecules of the pixel cell 101 in the 1st field and the 2nd field may be obtained based on the specification of the liquid crystal.

In the embodiment of the disclosure, before each frame is processed, if it is determined that the chromaticity coordinates corresponding to the colors of the light emitted by all the pixel cell 101 of the liquid crystal display panel 10 are around a fitted straight line, one frame may be divided into two fields, thereby reducing requirements for the response time of the liquid crystal.

Optionally, the time durations of the 1st field and the 2nd field are the same. Therefore, the trichromatic light provided by the OLED light source 20 which may be used as the backlight may be distributed more uniformly.

The above-described description is merely particular embodiments of the disclosure, but the scope of protection of the disclosure is not limited thereto. Various changes and modifications may be made by those skilled in the art without departing from the technical scope of the disclosure. Therefore, the scope of protection of the disclosure should be defined by the scope of protection of the appended claims.

What is claimed is:

1. A driving method for a field-sequential display panel which comprises: a lower substrate, an upper substrate and a liquid crystal layer between the lower substrate and the upper substrate; wherein the lower substrate comprises pixel cells on a base substrate, and each of the pixel cells comprises a thin film transistor; the field-sequential display panel further comprises an organic light-emitting diode (OLED) light source at one side of the base substrate away from the thin film transistor to provide trichromatic light for the pixel cells; and the OLED light source comprises a plurality of groups of trichromatic light sources; each of the groups of trichromatic light sources comprises a first color sub-light source, a second color sub-light source and a third color sub-light source; each of the first color sub-light source, the second color sub-light source and the third color sub-light source comprises an anode, a cathode and a light emitting layer between the anode and the cathode;

wherein the driving method comprises:

before each frame is processed, determining whether chromaticity coordinates corresponding to colors of light emitted by all the pixel cells are around a fitted straight line;

if determining that the chromaticity coordinates corresponding to the colors of the light emitted by all the pixel cells are around the fitted straight line, driving the first color sub-light source, the second color sub-light source and the third color sub-light source in the OLED light source to emit light with light intensities in a RM:GM:BM ratio in a 1st field of each frame, and driving the first color sub-light source, the second color sub-light source and the third color sub-light source in the OLED light source to emit light with light intensities in a RN:GN:BN ratio in a 2nd field;

driving liquid crystal molecules in the pixel cells to deflect in each field so that the pixel cells have target trichromatic brightness values in each frame, wherein $$X_1=2.7689R_M+1.7517G_M+1.1302B_M,$$

$$Y_1=1.0000R_M+5.5907G_M+0.0601B_M, Z_1=0R_M+0.0565G_M+5.5943B_M,$$

$$x_1=X_1/(X_1+Y_1+Z_1), y_1=Y_1(X_1+Y_1+Z_1);$$

$$X_2=2.7689R_N+1.7517G_N+1.1302B_N,$$

$$Y_2=1.0000R_N+5.5907G_N+0.0601B_N, Z_2=0R_N+0.0565G_N+5.5943B_N,$$

$$x_2=X_2/(X_2+Y_2+Z_2), y_2=Y_2/(X_2+Y_2+Z_2);$$

where x1 and y1, and x2 and y2 represent respectively maximum coordinates and minimum coordinates of the chromaticity coordinates corresponding to the colors of the light emitted by all pixel cells in each frame; and wherein the target trichromatic brightness values of each pixel cell in each frame are obtained by the following equation:

$$\begin{pmatrix} R_M & R_N \\ G_M & G_N \\ B_M & B_N \end{pmatrix}\begin{pmatrix} t_1 \\ t_2 \end{pmatrix}=\begin{pmatrix} R_1 \\ G_1 \\ B_1 \end{pmatrix},$$

where t1 and t2 represent respectively light transmittance of each pixel cell in the 1st field and the 2nd field, and R1, G1, and B1 represent respectively the target trichromatic brightness values of each pixel cell in each frame.

2. The driving method according to claim 1, wherein time durations of the 1st field and the 2nd field are the same.

* * * * *